US006618888B2

(12) United States Patent
Joynt et al.

(10) Patent No.: US 6,618,888 B2
(45) Date of Patent: Sep. 16, 2003

(54) DUAL DOWNFORCE MECHANISM FOR A CLEANING HEAD OF A SURFACE CONDITIONING VEHICLE

(75) Inventors: Daniel L. Joynt, Wyoming, MN (US); Lloyd D. Fortman, Golden Valley, MN (US)

(73) Assignee: Tennant Company, Minneapolis, MN (US)

( * ) Notice: Subject to any disclaimer, the term of this patent is extended or adjusted under 35 U.S.C. 154(b) by 75 days.

(21) Appl. No.: 10/034,230

(22) Filed: Dec. 20, 2001

(65) Prior Publication Data

US 2003/0000549 A1 Jan. 2, 2003

Related U.S. Application Data

(60) Provisional application No. 60/302,837, filed on Jul. 2, 2001.

(51) Int. Cl.[7] ..... B08B 1/04; A47L 11/16; A47L 11/00

(52) U.S. Cl. ..... 15/49.1; 15/50.1; 15/52.1; 15/320

(58) Field of Search ..... 15/49.1, 50.1, 15/52.1, 98, 320

(56) References Cited

U.S. PATENT DOCUMENTS 5,481,776 A 1/1996 Briscoe
5,483,718 A 1/1996 Blehert et al.
6,163,915 A 12/2000 Kaczmarz et al.
6,530,102 B1 * 3/2003 Pierce et al.

FOREIGN PATENT DOCUMENTS

EP 910981 A1 4/1999

OTHER PUBLICATIONS

International Search Report PCT/US02/19982, 4 pages, dated Nov. 7, 2002.

* cited by examiner

*Primary Examiner*—Randall E. Chin
(74) *Attorney, Agent, or Firm*—Fulbright & Jaworski L.L.P.

(57) ABSTRACT

The present invention relates to a simple mechanical dual stage pressure control for a cleaning head operatively coupled to a cleaning vehicle for engaging a surface to be cleaned and to methods of engaging and using such a dual stage pressure control to perform surface cleaning, surface maintenance, surface conditioning and the like. While the present invention is described and depicted primarily with reference to a cleaning head having dual rotary scrubbing brushes, the present invention finds diverse application in the art of surface cleaning, maintenance, conditioning and the like. Accordingly, the present invention is readily adaptable to cleaning heads having one or more of the following applications, including without limitation, such cleaning heads designed and adapted to: burnish, polish, scrub, sweep, brush, treat and wipe a surface to be cleaned wherein an increased downforce is beneficially selectively applied to such cleaning head to increase the efficacy of such cleaning head.

26 Claims, 4 Drawing Sheets

DUAL DOWNFORCE MECHANISM FOR A CLEANING HEAD OF A SURFACE CONDITIONING VEHICLE

RELATED APPLICATIONS

This application hereby incorporates by reference and, under 35 U.S.C. §119(e), claims the benefit of priority of U.S. Provisional Patent Application No. 60/302,837, filed Jul. 2, 2001.

FIELD OF THE INVENTION

The present invention relates generally to surface maintenance or conditioning machines, and particularly those machines employing one or more surface maintenance or conditioning appliances or tools that perform one or more tasks including, among others, scrubbing, sweeping, and polishing or burnishing. More specifically, the present invention is particularly directed to a variable down-force coupling system for such surface conditioning machines.

BACKGROUND OF THE INVENTION

Surface maintenance vehicles that perform a single surface maintenance or surface conditioning task are, of course, well known. Surface maintenance vehicles are generally directed to perform work in diverse maintenance, conditioning and cleaning applications such as for flooring surfaces. In this disclosure, the term floor refers to any support surface, such as, among others, floors, pavements, road surfaces, ship decks, and other surfaces to be cleaned and the like.

Commonly floor or surface maintenance machines are constructed having a single surface conditioning appliance or system so as to only sweep, others to scrub, while still others only to polish or burnish. It is of course possible to construct a single surface maintenance machine to perform one or more of the aforementioned surface maintenance tasks. One example of a multi-task floor conditioning machine is disclosed in U.S. Pat. No. 3,204,280, entitled "Floor Cleaning & Waxing Machine," the entire disclosure of which is incorporated by reference herein in its entirety for any and all purposes. Another is disclosed in U.S. Pat. No. 5,483,718, entitled, "Floor Scrubbing Machine Having Impact Energy Absorbtion," the entire disclosure of which is incorporated be reference herein in its entirety for any and all purposes. Disclosed therein is a forward mounted scrubber assembly that is followed by a squeegee assembly.

Scrubbing systems are well known in the art. Scrubbing systems commonly include a driver assembly and a rotatable scrubber in the form of a brush, pad, or the like. A control device may be utilized for controlling the degree of scrubbing (typically a function of down-force applied through the scrubber) applied to a floor surface depending upon the type and/or condition of floor surface intended to be scrubbed. The scrubber driver assemblies for scrubbing systems are well known in the art and commonly include one or more rotatable brushes driven by a driver motor affixed to a scrubber head. Scrubber heads of the prior art have been selectively raised and lowered by an actuator coupled to the driver so as to achieve an intended down force or scrubbing pressure of the srub pad against a floor surface. Examples of the latter are taught in U.S. Pat. Nos. 4,757,566, 4,769,271, 5,481,776, 5,615,437, 5,943,724, and 6,163,915, the entire disclosures of which are incorporated by reference herein in its entirety for any and all purposes. Common to some of the control systems of the aforementioned prior art is the employment of a current sensor that monitors the current drawn by the driver motor. In some of the aforementioned systems of the prior art a "pressure sensor" is employed that is representative of the pressure of the scrubber head against the floor. Still others attempt to control torque load on the motor indicated by the sensed motor current.

SUMMARY OF THE INVENTION

The present invention relates to an efficient structure for controlling the down force of a working head in engagement with a surface to be cleaned, maintained, or otherwise conditioned. The invention further relates to a method of engaging and using such a control structure to perform surface cleaning, surface maintenance, surface conditioning and the like. While the present invention is described and depicted primarily with reference to a cleaning head having dual rotary scrubbing brushes, the present invention finds diverse application in the art of surface cleaning, maintenance, conditioning and the like. Accordingly, the present invention is readily adaptable to cleaning heads having one or more of the following applications, including without limitation, such cleaning heads designated and adapted to: burnish, polish, scrub, sweep, brush, treat and wipe a surface to be cleaned wherein an ability to control the downforce of the head is beneficial. Of course, such cleaning head implements or cleaning head appliances may each be provided with an embodiment of the present invention and coupled to a single dedicated surface maintenance vehicle or to more than one such cleaning head coupled to a single vehicle.

In one embodiment, the invention is particularly applicable to a floor scrubbing machine having a scrub head mounted in front of the machine chassis. The scrub head includes a scrub brush or pad and a scrub driver. A linear actuator is utilized to raise and lower the scrub head relative to the floor surface. The scrub head has a predetermined weight which may be supported by the scrub brush in a first operational mode of use. In the first operational mode of use, the scrub head is floatingly supported by the machine so that the scrub head can follow the contours or undulations of the floor surface. In this mode of operation vertical movement of the scrub head relative to the machine is relatively unconstrained. In a second operational mode of use the floor scrubbing machine additionally engages the linear actuator for use in a second operational mode of use. In the second mode of use, the linear actuator may be engaged to transfer additional force to the scrub head, increasing the down force supported by the scrub pad, and increasing the relative scrubbing work performed by the machine. In the second mode of operation, movement of the scrub head relative to the machine is relatively constrained by the linear actuator One aspect of the present invention is the provision of a mechanical system for transferring between the first and second operational modes of use. An operator manipulable element may be utilized to change from the first operational mode of use to the second operational mode of use. An automatic disengagement for returning the machine to the first operational mode of use is also provided by one aspect of the present invention. In one embodiment, the automatic disengagement is in response to the scrub head being raised away from the floor surface toward its transport position.

The present invention provides several advantages over both prior art and contemporary apparatus for controlling the down force, and hence scrub pressure of a cleaning head coupled to a cleaning machine. The present invention may be implemented without a sophisticated electronic control.

As a result the present invention is generally lower cost, easier to maintain and less prone to breakage than prior art (and complex contemporary) cleaning head control mechanisms and algorithms.

DETAILED DESCRIPTION OF THE PREFERRED EMBODIMENTS

Figure 1:
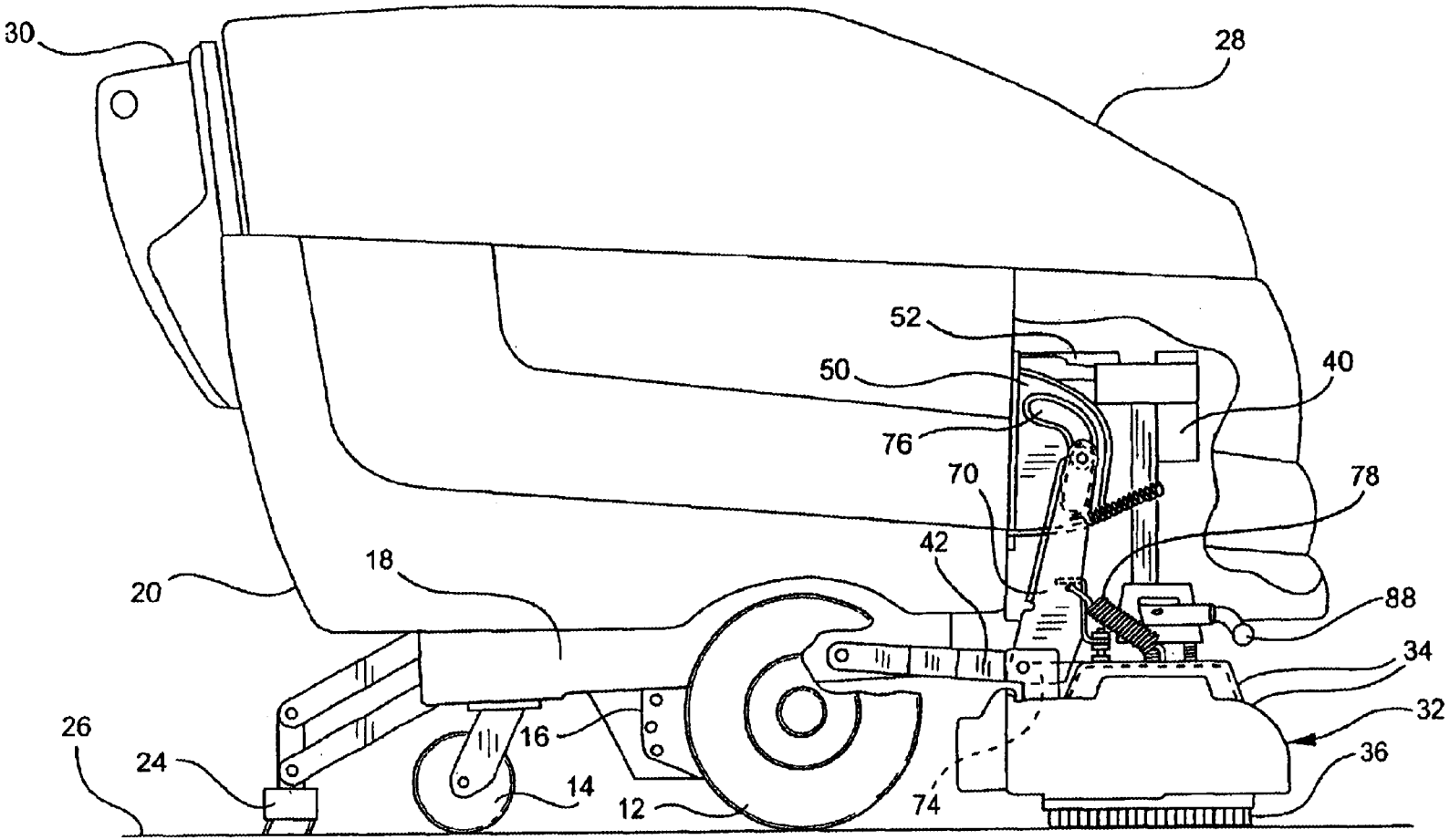
FIG. 1 is a side elevation view of a surface maintenance vehicle having a cleaning head coupled to said vehicle and incorporating aspects according to the present invention.

A floor scrubbing machine which uses the present invention is shown in normal operating position in FIG. 1. The scrubbing machine has two front wheels 12 and two rear caster wheels 14, and a transaxle 16 providing traction drive to the front wheels. The transaxle and rear casters are attached to a frame 18, which supports a housing 20. This housing encloses rechargeable batteries which supply energy to power the machine. It also contains a recovery tank to hold soiled scrub water recovered by a vacuum squeegee 24 from a floor 26 being scrubbed. A hinged lid 28 contains a tank for clean scrubbing solution to be dispensed to the floor and a vacuum fan to lift soiled scrub water from the floor via the squeegee 24 and deposit it in the recovery tank. A control console 30 provides necessary controls for an operator who walks behind the scrubber.

A scrub head 32 is shown in FIG. 1 in position to scrub the floor 26. A housing 34 encloses two scrub brushes 36. The brushes 36 are driven by two electric motors 38, shown in FIG. 3 but omitted for clarity in FIG. 1. An electric actuator 40 attached between the scrub head 32 and the housing 20 raises the scrub head 32 for transport, lowers it for work, and controls its down pressure on the floor. Additional aspects of the electric actuator 40 and associated mechanical coupling are described in more detail hereinafter.

Figure 2:
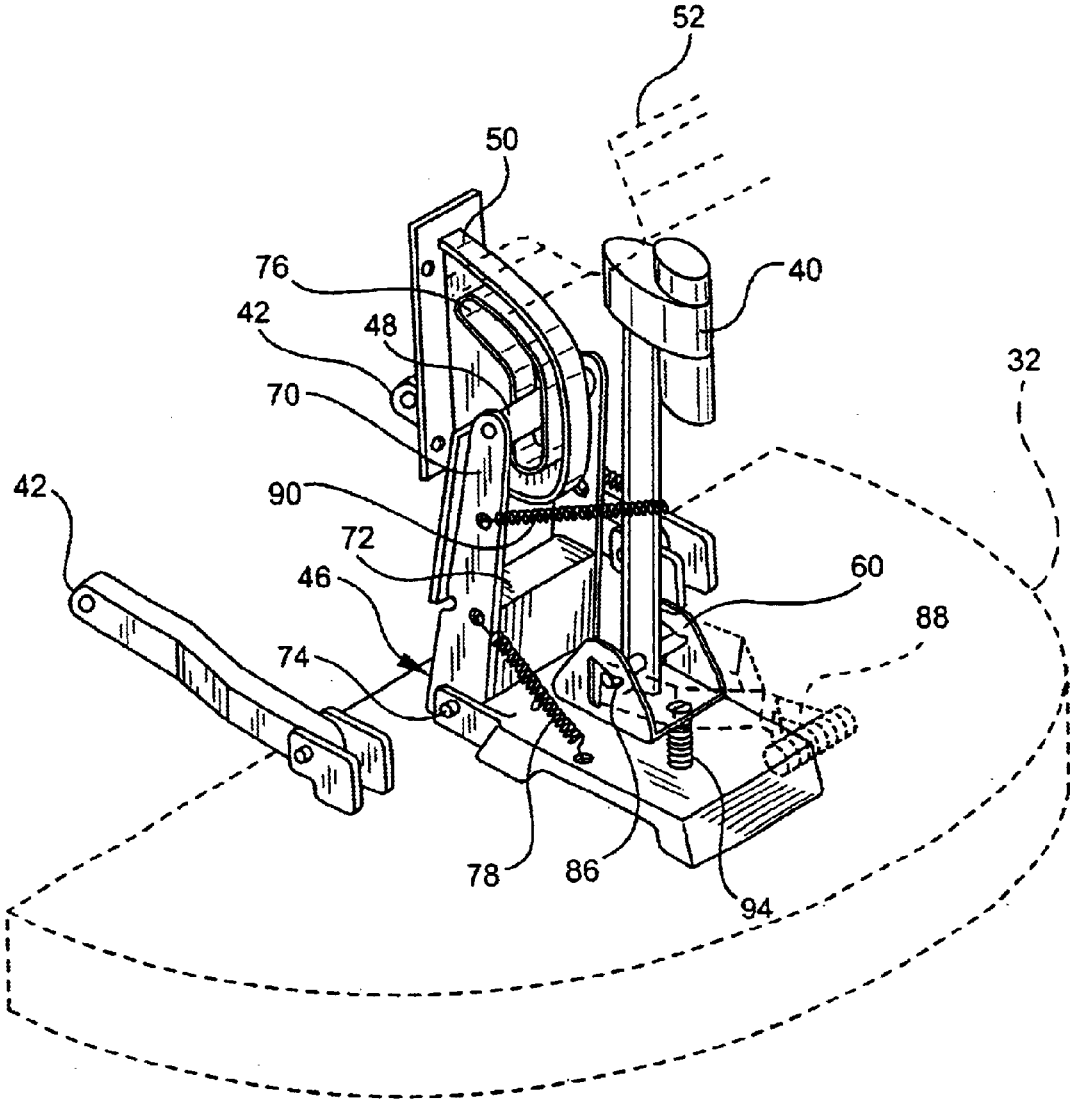
FIG. 2 is a perspective view of a portion of the surface maintenance vehicle of FIG. 1.
Figure 3:
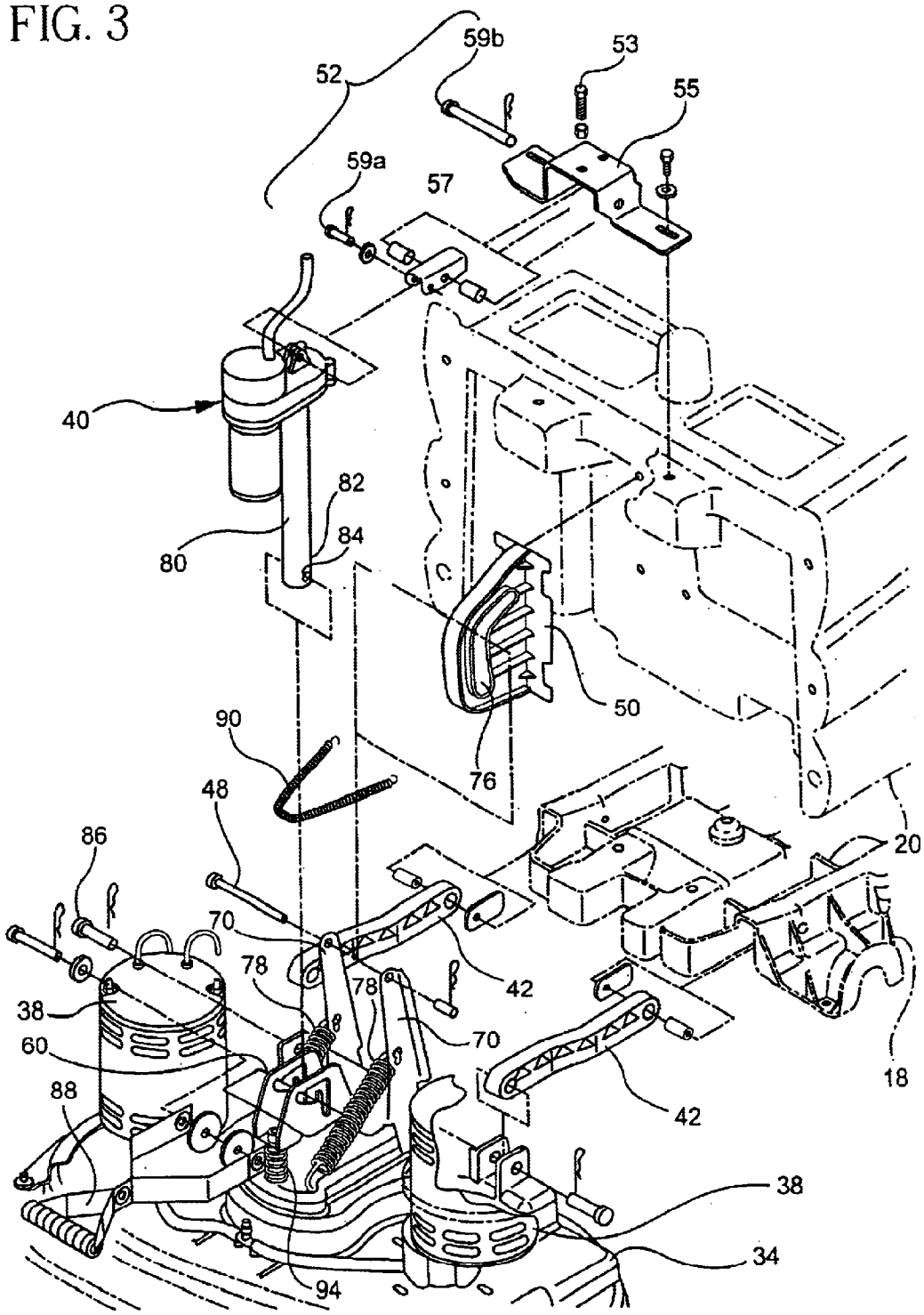
FIG. 3 is a perspective view of portions of the surface maintenace vehicle of FIGS. 1 and 2, shown in an unassembled, exploded view adjacent the frame of a surface maintenance vehicle and wherein coupling between such parts is shown in ghost.

The scrub head 32 as illustrated in FIGS. 1–3 uses two disk scrub brushes 36 rotating about parallel vertical axes. Alternatively, scrub heads may be made with only one disk scrub brush, or one or more cylindrical brushes rotating about horizontal axes. All of these variations can be applied to this invention. The illustrated scrubber is a relatively small model, controlled by an operator walking behind it. Scrubbers are made in much larger sizes, some of which have the operator riding on them. Again, the invention can be applied to larger machines if the essential elements of the invention are observed. While a scrub head 32 is depicted in FIGS. 1–3, any appliance or tool for providing surface maintenance, surface conditioning, and/or surface cleaning to a surface may be coupled to an associated machine or vehicle in accordance with the present invention.

FIG. 2 is a perspective view of a portion of the scrub head 32 and associated coupling structure. The scrub head 32 is attached to the frame 18 by a coupling structure which allows it to be raised and lowered and allows the brushes 36 to conform to undulations in the floor 26. The scrub head 32 is attached to the frame 18 by lower control arms 42, guide linkage 46/48/50, and electric linear actuator 40 and associated coupling structure, including an upper mount assembly 52 for securing one end of the linear actuator to the housing 20, and a lower bracket 60 for selectively securing the other end of the linear actuator 40 to the scrub head 32. Additional aspects of the lower bracket 60 are provided hereinafter. The two lower control arms 42 are attached to the frame 18 and the scrub head housing 34 with pivoted connections at their ends. Two upright arms 70 may be connected to bracket 72, to make an assembly 46. This part 46 is pivotally attached to the scrub head housing 34 at 74. Guide 50 is attached to the front wall of the housing 20. Guide 50 provides a slot 76 within which roller 48 can move up and down. This slot 76 has an arcuate lower portion which is generally vertical and an upper portion which slopes up and toward the rear. During normal operation roller 48 rides more or less midway in the lower portion of slot 76, where it moves through the same arc as the front pivots of arms 42 to keep the brushes 36 and scrub head 32 parallel to the floor 26 as the scrub head 32 rises and falls while passing over any undulations in the floor. Two springs 78 are attached between the scrub head housing 34 and the arms 70. Since the arms 70 are constrained at their upper ends by slot 76 and at their lower ends by pivot 74, the action of springs 78 is to tend to tilt the forward part of the scrub head upward around pivot 74. Scrub head 20 is caused to tilt when it is raised to ease access to the components thereof by an operator of vehicle 10. Additional aspects of the scrub head are disclosed in U.S. Pat. No. 5,483,718, incorporated by reference herein.

FIG. 3 is a perspective view of an embodiment of cleaning head 32 of the present invention shown in an unassembled, exploded view adjacent frame 18 and body 20 of surface maintenance vehicle 10 and wherein coupling between such parts is shown in ghost.

Linear actuator 40 is used to raise the scrub head 32 for transport, lower it for work in a first operational mode, and controls its down pressure on the floor in a second operational mode. Linear actuator assembly 40 preferably is an electric actuator having a leadscrew member 80. As in known in the art, leadscrew member 80 has a thread set formed thereupon and has a distal end 82 which is movable in response to leadscrew 80 rotation. Additional linear actuators may include hydraulic or hybrid electro-hydraulic devices (not shown). The distal end 82 of leadscrew member 80 has a pin-receiving aperture 84 formed therein. A pin 86 coupled to the aperture 84 may engage dual stage bracket 60 as described herein. As described in more detail herein, pin member 86 also is coupled to a manual transition device 88 which preferably comprises a strap member having a handle for ease of manipulation by an operator of vehicle 10. The precise sequence of moving pin 86 in elongate pathway of dual stage bracket 60 is later described with respect to FIG. 4.

A biasing spring member 90 is preferably provided that engages the linear actuator 40. The biasing spring member 90 provides a force that assists in the placement of pin member 86 in the pathway of dual stage bracket 60. Biasing spring member 90 assists in the movement of pin member 86 (and thus the distal end 82 of the leadscrew member 80) when the scrub head 32 is raised (thus returning the scrub head to a default operational state).

FIG. 3 illustrates additional aspects of the upper mount assembly 52 which couples the linear actuator 40 to the housing 20. Upper mount assembly 52 includes a threaded adjustment device 53 which engages a plate member 55 and a channel member 57. Channel member 57 is coupled to the linear actuator 40 and the plate member 55 through associated pins 59*a* and 59*b*. The threaded adjustment device 53, in the illustrated embodiments being a threaded fastener, may be manipulated during manufacturing or subsequent servicing to adjust the relative position of the linear actuator to the housing 20. An adjustment may be required to select a predetermined amount of down force exerted by the linear actuator 40. Upper mount assembly 52 is thus adjustable to compensate for manufacturing variances of the linear actuator 40 and housing 20. Adjustments may be made to the relative position of the linear actuator 40 via threaded adjustment device 53 as required during a servicing procedure.

Figure 4:
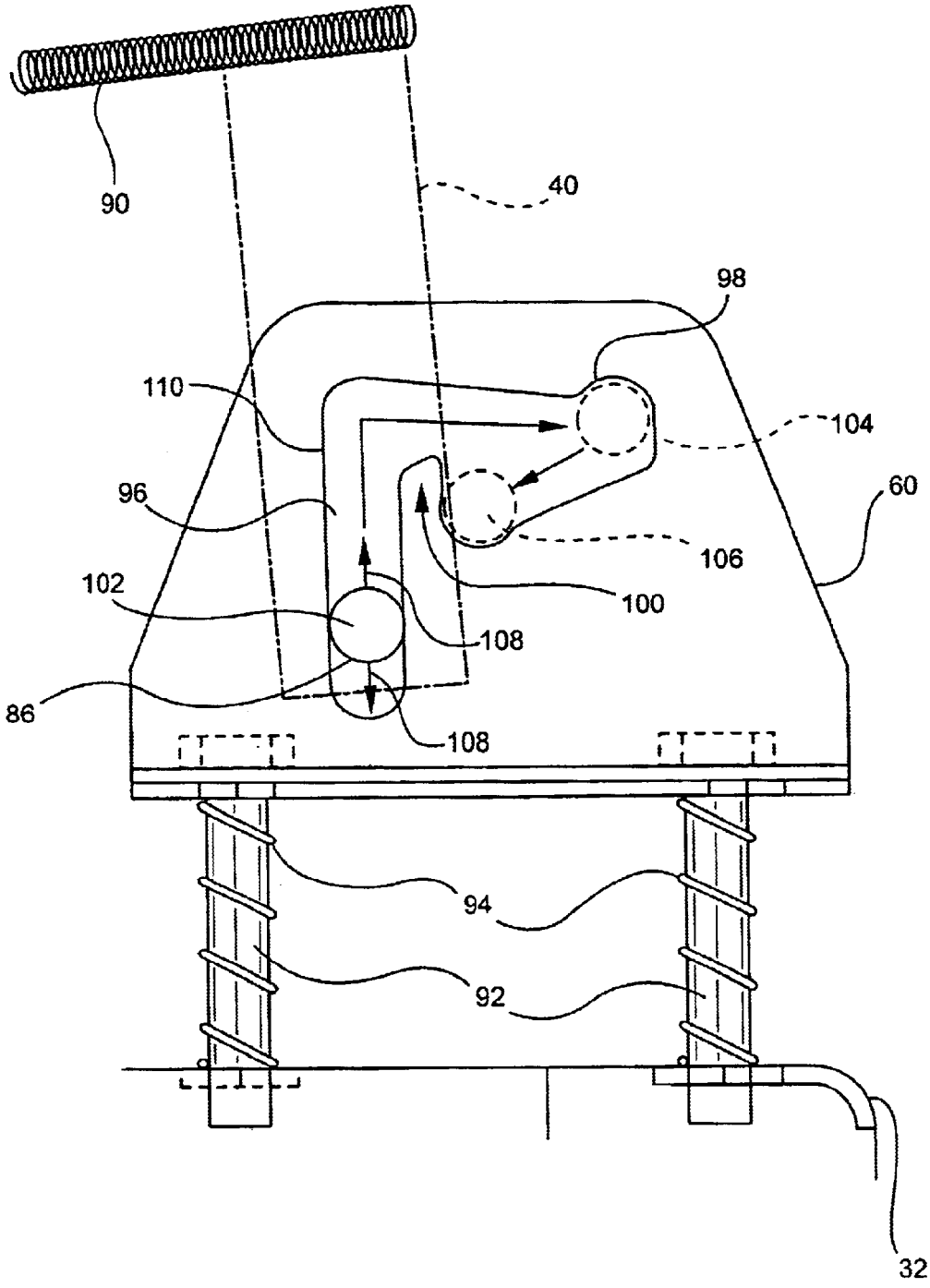
FIG. 4 is an side elevation view of a preferred embodiment of a dual-stage bracket according to the present invention.
Figure 3:
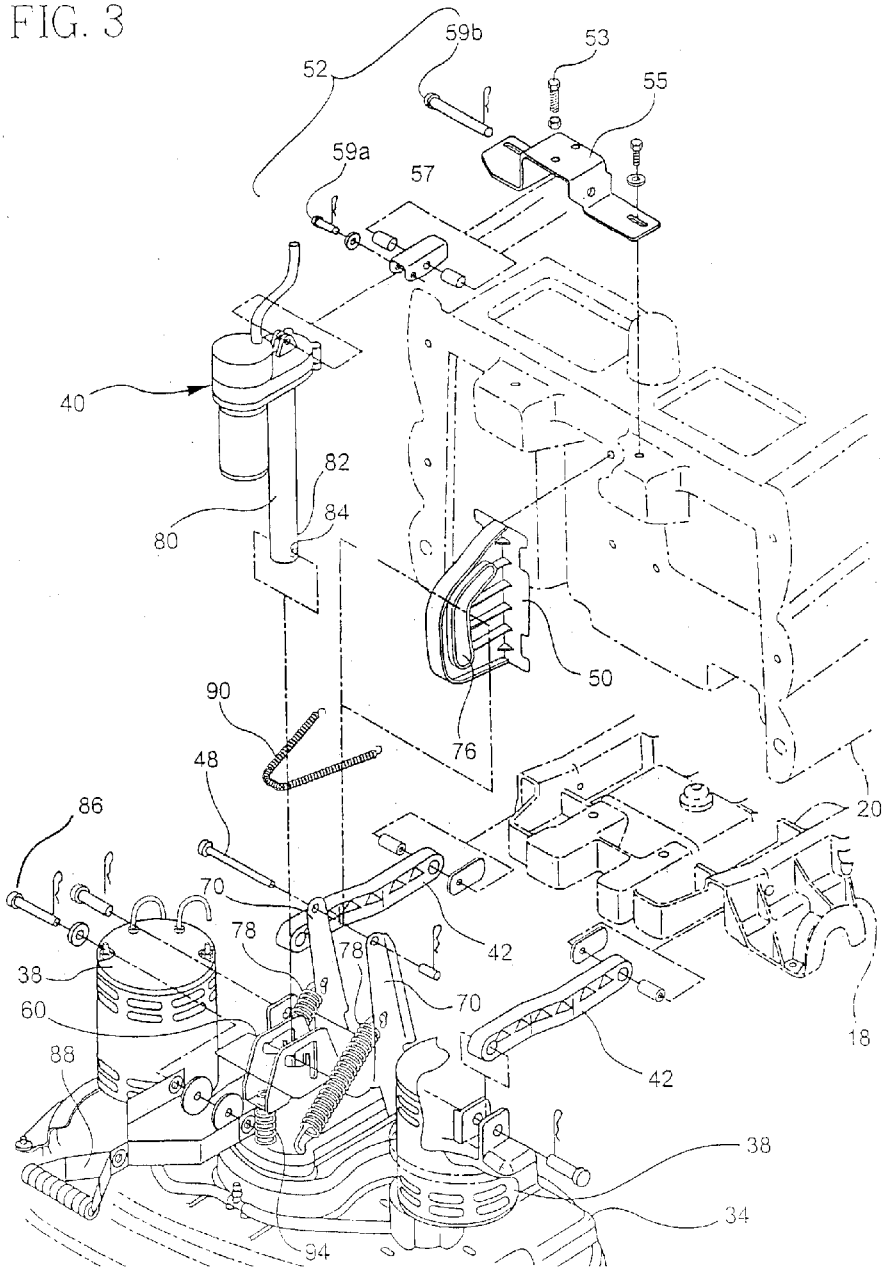

Referring now to FIG. 4, the dual stage bracket 60 is attached to the housing 32 by a pair of threaded fasteners 92 disposed through a pair of additional "travel" springs 94. Dual stage bracket 60 defines a range of positions for the constrained pin 86 (and thus linear actuator 40) relative to the scrub head 32. Dual stage bracket 60 includes a configured aperture having a channel portion 96, an intermediate detent portion 98, and a shoulder portion 100. As illustrated in FIG. 4, discrete pin 86 locations may be defined in dual stage bracket 60, including, a "floating" position 102 within the channel 96, a middle or "transition" position 104 proximate to the detent portion 98, and a "high force" position 106 proximate to the shoulder portion 100. When the pin 86 is within the channel portion 96 (position 102), the scrub head 32 is relatively unconstrained by the linear actuator 40 and can move vertically (to displace pin within channel 96) to follow minor undulations in the floor surface 26. The linear actuator 40 is not under axial load from the scrub head 32, i.e., the linear actuator 40 does not transfer an axial force to increase the down force of the scrub head 32. Minor movement of the scrub head 32 causes the pin 86 to deviate (generally vertically) from within channel 96 as depicted by arrows 108. The machine operating with the pin 86 in position 102 may be characterized as being in a first mode of operation. In the first mode of operation, the scrub brush 36 pressure is a function of the scrub head mass and no additional machine weight is transferred to the scrub head 32. For general scrubbing operations, the first mode of operation provides generally sufficient performance.

A second operational mode is defined by the present invention. The machine may be characterized as being in a second, "heavy scrub" mode of operation when the pin 86 is proximate the shoulder portion 100. When the pin is in position 106, the scrub head 32 is constrained by the linear actuator 40. The linear actuator 40 is in direct axial engagement with the scrub head 32 and is able to transfer a force through bracket 60 and travel springs 94 to the scrub head 32 to increase the downward force of the scrub head 32. In this regard, the linear actuator 40 transfers a portion of the machine weight to the scrub head unit 32 to increase the scrubbing down force and increase the scrubbing action to the floor surface. In the second operational mode, the travel springs 94 are slightly compressed and transfer the additional down force to the scrub head 32, while providing a range of vertical movement to the scrub head 32 to permit the scrub head 32 to follow the ground surface as in the first mode of operation. FIG. 2 illustrates the machine as being in a second mode of operation. In the second mode of operation, the scrub brush 36 pressure is controlled by the linear actuator 40. A controller (not shown) may be utilized to provide a variable down force (via variable displacement of the actuator) to the scrub head 32 in the second mode of operation. For aggressive or heavy scrubbing operations, the second mode of operation provides increased scrubbing performance. In a preferred embodiment of the present invention the level of downforce in the first "floating mode" of operation is roughly half the magnitude of the "high force" mode of operation The movement of the pin 86 relative to the bracket 60 is controlled, at least in part by an operator manipulable handle 88. Handle 88 may be accessed via an aperture in the housing 20. Handle 88 may be grasped by an operator and pulled away from the machine to transition the machine between its first mode of operation into its second mode of operation. An intermediate position 104 of the pin 86 within the dual stage bracket 60 is provided whereby the pin 86 is engaged by a detent portion 98 of the bracket 60. With the pin 86 engaged by the detent portion 98, the scrub head 32 can be lowered into engagement with the floor surface with the pin 86 travelling into position 106 adjacent the shoulder portion 100. Upon raising the scrub head 32 from the work surface after a heavy scrubbing operation, the linear actuator 40 is biased by the spring 90 to return the pin 86 from position 106 to a position proximate to its rear face 110 of bracket 60, thus returning the machine to its normal operation configuration. As such, an automatic transition occurs between the second "heavy" scrub mode of operation and the first "normal" mode of operation as the scrub head is raised from the floor surface 26.

A method of transitioning a scrubber from a first "normal" operating mode to a second "heavy" operating mode comprises the following steps: accessing a scrubber in a first "normal scrub" mode of operation; raising the scrub head 32 away from the floor surface; actuating a strap member 88 so that a pin member 86 coupling cleaning head 32 to the vehicle is displaced into engagement with a detent portion 98; and engaging the linear actuator 40 to lower the scrub head 32 toward the floor surface so that the pin 86 is moved into contact with shoulder portion 100; and further engaging the linear actuator 40 to transfer additional downforce to the scrub head 32.

Additional considerations and alternative embodiments with respect to the present invention may include substituting or eliminating certain components and/or subcomponents of the illustrated embodiment. For example, a first and second magnitude of downforce may be provided that different by a simple integer value of magnitude (i.e., one is double or triple the other) or any fractional difference of downforce. As also noted above, manual actuator or strap member 88 may be disposed adjacent leadscrew member 80 as depicted herein or may be remotely mechanically coupled, or may be electronically actuated locally or remotely by an operator of vehicle 10. If actuator 40 or strap member 88 is remotely activated additional mechanical (or electronic) means of actuating pin member 86 travel between positions 102 and 106 may be required. With respect to intermediate position 104, alternative embodiments may dispense with intermediate position 104 entirely and provide for a direct transition from floating position 102 high force position 106 without departing from the spirit and scope of the present invention. While bracket 60 has a path for pin member 86 to navigate between a floating position 102 and high force position 106, a rotary cam which creates displacement, for example with an offset eccentric portion or offset pin location(s) may be used to perform substantially the same function as dual stage bracket 60 of the present invention.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An apparatus for coupling a surface conditioning head to a surface maintenance vehicle comprising:

a surface conditioning head for performing a surface conditioning procedure to a floor surface;

a linear actuator for raising the surface conditioning head into a transport position and for lowering the surface conditioning device into an operating position in contact with the floor; and a coupling structure for connecting the surface condition head to the vehicle, wherein the coupling structure provides for movement of the surface conditioning head between the transport position and the operating position, said coupling structure defining at least a pair of operational conditions with the surface conditioning head in its operating position, including a first operational condition wherein the surface conditioning head is disengaged from the linear actuator and contacts the floor surface with a first operational down force, and a second operational condition wherein the surface conditioning head is engaged by the linear actuator to contact the floor surface with a second operational down force which is substantially larger than the first operational down force.

2. An apparatus according to claim 1 wherein the coupling structure includes a bracket disposed upon the surface conditioning head and cooperating with a distal end of the linear actuator.

3. An apparatus according to claim 2 wherein the bracket defines a plurality of positions for the distal end of the linear actuator relative to the surface conditioning head.

4. An apparatus according to claim 1 wherein the coupling structure includes a device for user manipulation which transitions the coupling structure from the first operational condition to the second operational condition.

5. An apparatus according to claim 1 wherein the coupling structure includes a device for automatically transitioning the coupling structure from the second operational condition to the first operational condition.

6. An apparatus according to claim 5 wherein the device for automatically transitioning the coupling structure from the second operational condition to the first operational condition is activated in response to the linear actuator raising the surface conditioning head.

7. An apparatus for coupling a surface conditioning head to a surface maintenance vehicle comprising:

a surface conditioning head for performing a surface conditioning procedure to a floor surface;

a linear actuator for raising the surface conditioning head into a transport position and for lowering the surface conditioning device into an operating position in contact with the floor; and a coupling structure for selectively connecting the linear actuator to the surface conditioning head, said coupling structure including a first position wherein the linear actuator is disengaged from the surface conditioning head such that the surface conditioning head can be vertically biased by undulations of the floor surface without engagement with the linear actuator, and a second condition wherein the linear actuator is engaged with the surface conditioning head such that the linear actuator transfers an additional force to the surface conditioning head.

8. An apparatus according to claim 7 wherein the coupling structure includes a bracket disposed upon the surface conditioning head and cooperating with a distal end of the linear actuator.

9. An apparatus according to claim 8 wherein the bracket defines a plurality of positions for the distal end of the linear actuator relative to the surface conditioning head.

10. An apparatus according to claim 7 wherein the coupling structure includes a device for user manipulation which transitions the coupling structure from the first operational condition to the second operational condition.

11. An apparatus according to claim 7 wherein the coupling structure includes a device for automatically transitioning the coupling structure from the second operational condition to the first operational condition.

12. An apparatus according to claim 11 wherein the device for automatically transitioning the coupling structure from the second operational condition to the first operational condition is activated in response to the linear actuator raising the surface conditioning head.

13. A surface maintenance vehicle comprising:

a surface conditioning head for performing a surface conditioning procedure to a floor surface;

a mechanical actuator for lowering the surface conditioning device into an operating position in contact with the floor; and a coupling structure for selectively connecting the mechanical actuator to the surface conditioning head, said coupling structure defining a first position wherein the mechanical actuator is disengaged from the surface conditioning head such that the surface conditioning head can be vertically biased by undulations of the floor surface without engagement with the linear actuator, and a second condition wherein the mechanical actuator is engaged with the surface conditioning head such that the mechanical actuator can transfer an additional force to the surface conditioning head.

14. An apparatus according to claim 13 wherein the mechanical actuator is also for raising the surface conditioning head into a transport position.

15. An apparatus according to claim 14 wherein the mechanical actuator is an electric linear actuator.

16. An apparatus according to claim 15 wherein the coupling structure includes a bracket disposed upon the surface conditioning head and cooperating with a distal end of the mechanical actuator.

17. An apparatus according to claim 16 wherein the bracket defines a plurality of positions for the distal end of the mechanical actuator relative to the surface conditioning head.

18. An apparatus according to claim 14 wherein the coupling structure includes a device for user manipulation which transitions the coupling structure from the first operational condition to the second operational condition.

19. An apparatus according to claim 14 wherein the coupling structure includes a device for automatically transitioning the coupling structure from the second operational condition to the first operational condition.

20. An apparatus according to claim 19 wherein the device for automatically transitioning the coupling structure from the second operational condition to the first operational condition is activated in response to the linear actuator raising the surface conditioning head.

21. A control device for a surface maintenance vehicle having a surface conditioning head, said surface conditioning head for performing a surface conditioning procedure to a floor surface, said vehicle having a mechanical actuator disposed thereupon, said control device comprising:

a coupling structure in operative engagement with both the mechanical actuator and the surface conditioning head, said coupling structure having a first orientation wherein the mechanical actuator is disengaged from the surface conditioning head such that the surface conditioning head can be vertically biased by undulations of the floor surface without engagement with the mechanical actuator, and a second orientation wherein the mechanical actuator is engaged with the surface conditioning head such that the mechanical actuator can transfer an additional force from the vehicle to the surface conditioning head.

22. A control device of claim 21 wherein the mechanical actuator is used to raise and lower the surface condition head relative to the floor surface.

23. A control device of claim 21 wherein the coupling structure includes a device for user manipulation which transitions the coupling structure from the first orientation to the second orientation.

24. A control device of claim 21 wherein the coupling structure includes a device for automatically transitioning the coupling structure from the second orientation to the first orientation.

25. A method of operating a surface maintenance vehicle including the steps of:

providing a surface conditioning head for performing a surface conditioning procedure to a floor surface;

providing a linear actuator for raising the surface conditioning head into a transport position and for lowering the surface conditioning device into an operating position in contact with the floor;

providing a coupling structure for selectively connecting the linear actuator to the surface conditioning head;

placing the coupling structure in a first operating position wherein the linear actuator is disengaged from the surface conditioning head;

operating the surface maintenance vehicle with the coupling structure in the first operating position such that the surface conditioning head can be vertically biased by undulations of the floor surface without engagement with the linear actuator;

placing the coupling structure in a second operating condition wherein the linear actuator is engaged with the surface conditioning head; and operating the surface maintenance vehicle with the coupling structure in the second operating position such that the linear actuator can transfer an additional force to the surface conditioning head.

26. The method of claim 25, further including the step of raising the surface conditioning head from the operating position to the transport position wherein the coupling structure is reset into its first operating position.

* * * * *

UNITED STATES PATENT AND TRADEMARK OFFICE

CERTIFICATE OF CORRECTION

PATENT NO. : 6,618,888 B2
DATED : September 16, 2003
INVENTOR(S) : Fortman, L.D. et al.

It is certified that error appears in the above-identified patent and that said Letters Patent is hereby corrected as shown below:

Drawings,
Delete Fig. 3 and replace with the attached Fig. 3

Signed and Sealed this

Thirteenth Day of January, 2004

JON W. DUDAS
*Acting Director of the United States Patent and Trademark Office*